US005211785A

United States Patent [19]

Hughes

[11] Patent Number: 5,211,785

[45] Date of Patent: May 18, 1993

[54] METHOD FOR MAKING A BODY OF PARTICULATE INSULATING MATERIAL

[75] Inventor: John T. Hughes, Worcestershire, United Kingdom

[73] Assignee: Micropore International Limited, Droitwich, United Kingdom

[21] Appl. No.: 741,272

[22] Filed: Aug. 7, 1991

[30] Foreign Application Priority Data

Aug. 7, 1990 [GB] United Kingdom ..... 9017279

[51] Int. Cl.[5] ..... B32B 17/00; B32B 1/04

[52] U.S. Cl. ..... 156/62.2; 156/242; 156/245; 428/76

[58] Field of Search ..... 156/62.2, 296, 213, 156/245, 242, 62.6; 428/72, 74, 76

[56] References Cited

U.S. PATENT DOCUMENTS

| | | | |
|---|---|---|---|
| 3,962,014 | 6/1976 | Hughes et al. | 428/76 X |
| 4,187,353 | 2/1980 | Schroeder | 521/149 |
| 4,359,496 | 11/1982 | Kratel et al. | 156/213 X |
| 4,399,175 | 8/1983 | Kummermehr et al. | 428/76 |
| 4,444,821 | 4/1984 | Young et al. | 428/74 X |
| 4,447,345 | 5/1984 | Kummermehr et al. | 428/76 X |
| 4,556,593 | 12/1985 | Hughes | 428/72 |
| 4,617,219 | 10/1986 | Schupack . | |
| 4,636,416 | 1/1987 | Kratel et al. | 428/76 X |
| 4,675,225 | 6/1987 | Cutler | 428/74 |
| 4,726,974 | 2/1988 | Nowobilski et al. | 428/74 X |
| 4,824,507 | 4/1989 | D'Amico | 156/245 |
| 4,880,680 | 11/1989 | Kistner | 428/76 X |
| 5,094,899 | 3/1992 | Rusek, Jr. | 428/76 X |
| 5,098,498 | 3/1992 | Hale et al. | 156/213 |

FOREIGN PATENT DOCUMENTS

| | | | |
|---|---|---|---|
| 2304034 | 6/1970 | Fed. Rep. of Germany . | |
| 3713526 | 2/1988 | Fed. Rep. of Germany | 428/76 |
| 759921 | 10/1956 | United Kingdom | 428/74 |
| 1350661 | 1/1973 | United Kingdom . | |

*Primary Examiner*—Jeff M. Aftergut
*Attorney, Agent, or Firm*—Browdy and Neimark

[57] ABSTRACT

A non-planar formed body of particulate insulating material is made by first compacting substantially inorganic non-fusible particulate insulating material to form a plane panel. Covering material such as glass cloth coated with a settable composition or thermoplastic material effectively comprising a settable composition, is disposed adjacent one or both faces of the plane panel, in a mould. The mould is then operated to form the panel into the desired non-planar form, and the settable composition is allowed to harden.

18 Claims, 2 Drawing Sheets

METHOD FOR MAKING A BODY OF PARTICULATE INSULATING MATERIAL

FIELD OF THE INVENTION

The present invention relates to a method for making a body of particulate insulating material, and in particular relates to a method for making a non-planar formed body of particulate insulating material.

DESCRIPTION OF PRIOR ART

A known form of high performance thermal insulating material comprises compacted microporous silica particles, and typically includes ceramic fibre reinforcement and rutile powder opacifier. Such an insulating material is described, for example, in GB-A-1 350 661.

The term 'microporous' is used herein to identify porous or cellular materials in which the ultimate size of the cells or voids is less than the mean free path of an air molecule at NTP, i.e. of the order of 100 nm or smaller. A material which is microporous in this sense will exhibit vary low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electrothermal types in which the average ultimate particle size is less than 100 nm. Any of these materials, based for example on silica, alumina or other metal oxides, may be used to prepare a composition which is microporous as defined above.

Microporous thermal insulating material as described above provides a very efficient thermal insulation, permitting for example for the effective insulation of high temperature regions in a confined space. Thus it is frequently desired to make insulating components of various shapes for incorporation in articles requiring such insulation.

However, such insulating material, being essentially composed of compressed substantially inorganic non-fusible particulate materials, has a relatively low tensile strength and is not resistant to abrasion. Thus, although the insulating material can in principle be moulded into various shapes, it is difficult to make even small articles in non-planar form which are sufficiently strong to retain their structural integrity during transport and assembly of the complete article.

A further problem with moulding the insulating material is that the compressed material expands once the compressing force is removed. This makes the final shape of a moulded shape difficult to predict and also renders a moulding operation undesirably complex and expensive to perform.

The moulding of plane panels is not beset by the same complexity because, for example, there are no curves to form to a desired degree of curvature. Nevertheless, because of the low tensile strength of the insulating material, it is generally not possible subsequently to form a plane panel into a non-planar body because the insulating material cracks and loses its integrity.

It is also known to form a plane insulating panel by compressing a microporous thermal insulating material within a closed bag of, for example, glass fibre cloth, as also described in GB-A-1 350 661. Although this provides plane panels which exhibit reasonable handleability and resistance to abrasion, it is not well suited to the production of insulating components of small size, and in particular does not facilitate manufacture to precise, repeatable dimensions. Moreover, this method is not capable of producing non-planar formed bodies.

Nevertheless, in view of the excellent thermal properties of such insulating materials there is a demand, in situations where plane panels are unsuitable, for non-planar formed bodies of the material.

OBJECT OF THE INVENTION

It is an object of the present invention to provide a method of making a non-planar formed body with reasonable handling characteristics and resistance to abrasion from a plane panel of compacted substantially inorganic non-fusible particulate insulating material.

SUMMARY OF THE INVENTION

According to a first aspect of the present invention there is provided a method for making a non-planar formed body of particulate insulating material, comprising the steps of:

compacting substantially inorganic non-fusible particulate insulating material to form a plane panel;

disposing covering material coated with or comprising a settable composition adjacent at least one face of the plane panel, in a forming means;

operating the forming means to form the panel into the desired non-planar form; and allowing the settable composition to harden.

Covering material coated with or comprising a settable composition may be disposed adjacent a second face of the plane panel. The covering material adjacent a second face of the panel may be applied after the panel has been formed into the desired non-planar form.

According to a second aspect of the present invention there is provided a method for making a non-planar formed body of particulate insulating material, comprising the steps of:

compacting substantially inorganic non-fusible particulate insulating material to form a plane panel;

disposing covering material coated with or comprising a settable composition in a forming means;

disposing the plane panel on the layer of covering material;

disposing covering material coated with or comprising a settable composition on the plane panel;

operating the forming means to form the panel into the desired non-planar form; and allowing the settable composition to harden.

In the method according to the second aspect of the present invention, covering material may be disposed on the plane panel as aforesaid after the panel has been formed into the desired non-planar form.

The forming means may comprise upper and lower formers shaped according to the desired shape of the formed body, or may comprise a mould.

The covering material may be glass cloth, textile cloth, metal cloth or metal foil.

The settable composition may comprise water glass.

Alternatively, the covering material may comprise a thermoplastic material.

For a better understanding of the present invention and to show more clearly how it may be carried into effect reference will now be made, by way of example, to the accompanying drawings in which:

DESCRIPTION OF PREFERRED EMBODIMENT

Figure 1:
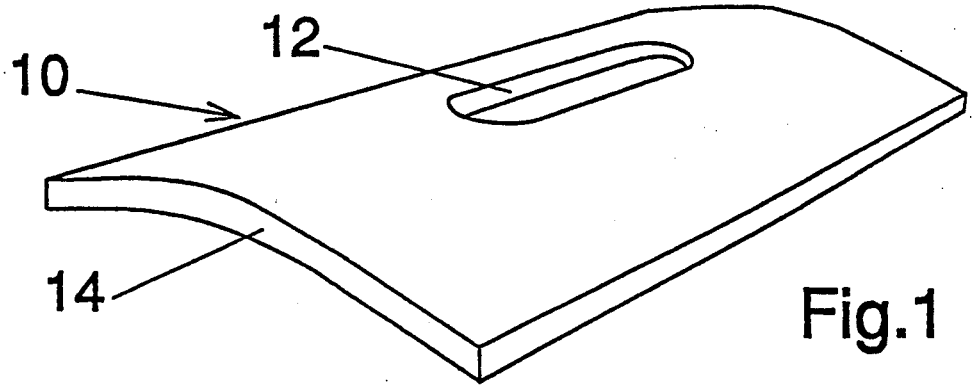
FIG. 1 is a perspective view of a formed body of particulate insulating material made in accordance with the present invention.

Referring to FIG. 1, a formed body 10 of thermal insulating material is shown in the shape of part of the surface of a cylinder, that is curved in one direction and rectilinear in the orthogonal direction. This body is made from a mixture of highly-dispersed pyrogenic silica, alumino-silicate ceramic fibre reinforcement and rutile powder opacifier, mixed together and compacted in known manner to form a substantially inorganic non-fusible material 12 having low tensile strength and poor handling characteristics, but very high thermal insulation material performance. The material 12 is covered with glass fibre cloth 14 to protect the insulating material from abrasion and to improve the handling characteristics of the formed body 10.

The body 10 is made by first mixing the constituents of the insulating material in the following proportions by weight:

Pyrogenic silica: 62%
Ceramic fibre: 5%
Rutile powder: 33%

The mixture is placed in a die of a press tool and compacted to produce a plane rectangular panel of insulating material having the desired thickness of the body 10. Although the panel expands after compaction it is not difficult to produce a plane panel having a desired thickness. During the compaction the volume of the insulating material will be reduced by, typically, five-fold or more, to result in a density of the order of 300 $kgm^{-3}$.

Figure 2:
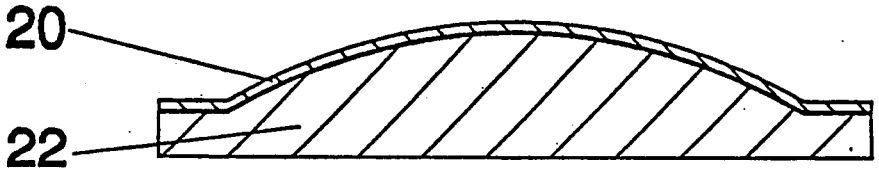
FIGS. 2 to 4 show successive steps of the method according to the present invention.

Referring to FIG. 2, a sheet of glass fibre cloth 20 having somewhat larger dimensions than the dimensions of a face of the rectangular panel of insulating material is coated with a settable composition in the form of an aqueous solution of sodium silicate (water glass) and placed on a lower former 22 shaped to conform to the final desired shape of the body 10.

Figure 3:
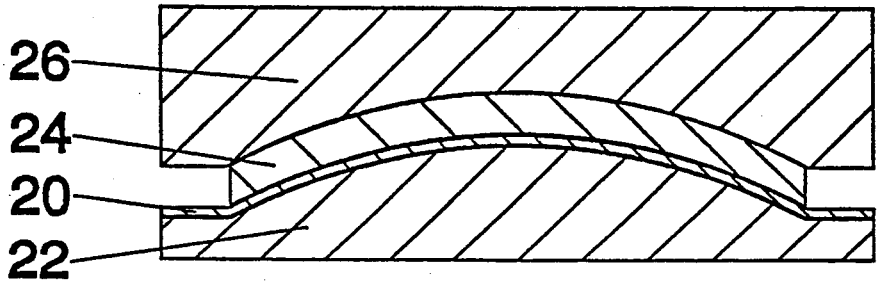

The rectangular panel 24 of insulating material is placed on the glass fibre cloth 20, and an upper former 26 complementary to the lower former 22 is placed over the insulating material and pressed down to form the desired shape of the body 10, as shown in FIG. 3.

Figure 4:
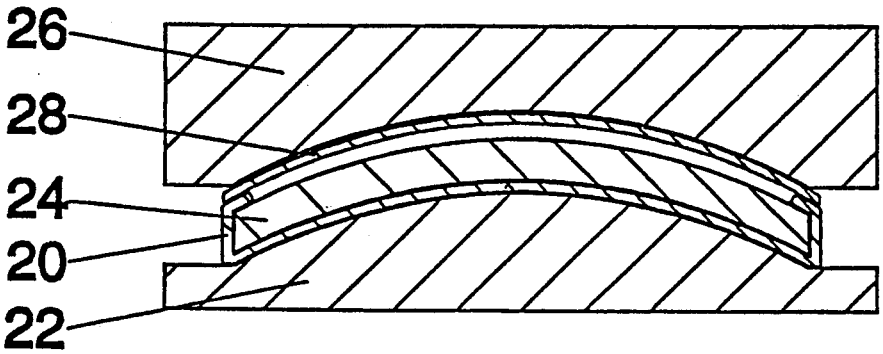

The upper former 26 is removed and the protruding edges of the glass fibre cloth 20 are wrapped around the sides of the panel 24. If necessary, the protruding edges extending along the curved sides of the panel 24 can be slit at intervals to permit the wrapped edges to conform to the curvature. A second sheet of glass fibre cloth 28 having the same dimensions as a face of the panel 24 is coated with water glass and placed on the exposed face of the panel. Thereafter, the upper former 26 is re-applied to the sandwich of insulating material and glass fibre cloth to maintain the desired shape while the water glass sets, as shown in FIG. 4. It should be noted in relation to this embodiment that water glass sets at room temperature and that no heating of the formers 22, 26 or any other component is required.

The pressing of the panel 24 may well cause cracks to form in the panel due to its low tensile strength, but when the water glass has hardened it is found that the combination of the panel 24 and the glass fibre cloth 20, 26 have resulted in a self-supporting insulating body which has the required shape and is reasonably resistant to abrasion and deformation being formed.

Figure 5:
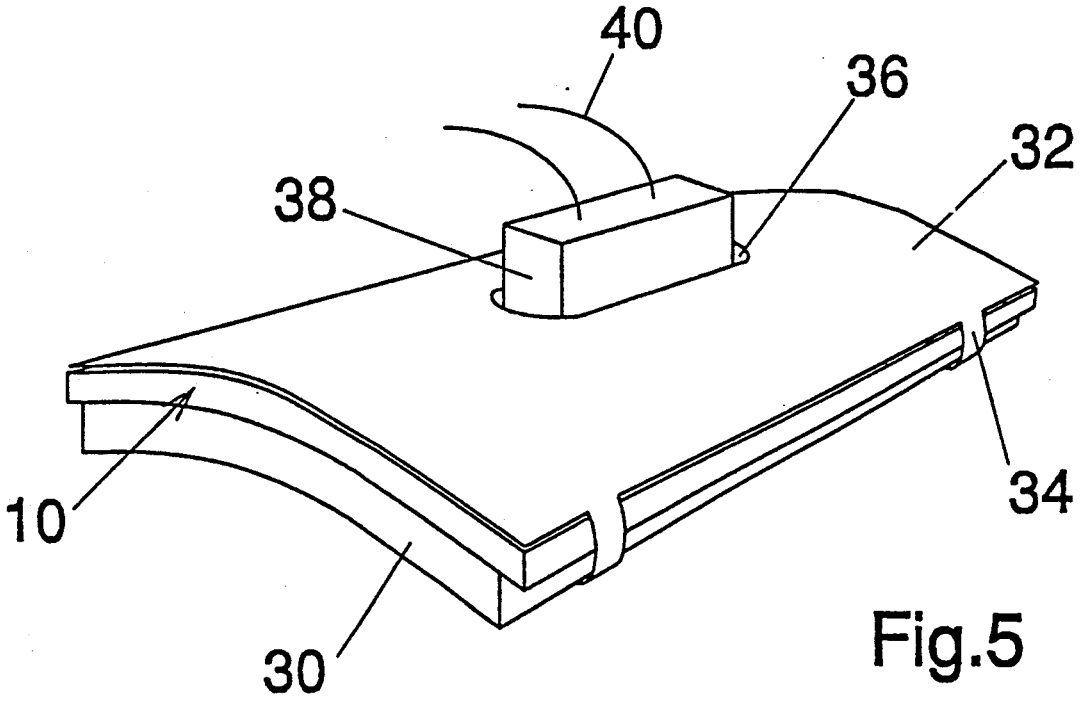
FIG. 5 is a perspective view of the formed body of FIG. 1 in combination with a heater.

The body 10 shown in FIG. 1 can be used, for example, as backing insulation for a curved heater comprising a heating element embedded in ceramic. As shown in FIG. 5, the body 10 can be secured to the heater 30 by sandwiching it between the heater 30 and a matching metal plate 32 having lugs 34 which are bent around the edge of the body 10 to engage the edges of the heater. An aperture 36 is provided in the centre of the body 10, as shown in FIG. 1, to accommodate a bushing 38 on the rear of the heater through which extend connecting wires 40 for the heating element. This aperture may be cut in the insulation with a knife and covered in glass cloth or coated with water glass.

Various modifications may be made to the method as described above by way of example. Thus, other inelastic covering materials may be used, such as textile cloth, metal cloth or metal foil. Covering material may be applied to both surfaces of the plane panel of insulating material before it is formed into its final shape. Alternatively, covering material may be applied to only a single face of the panel, even in the completed article. The covering material may be applied to the panel before either is placed on the former. In place of a settable composition applied to a covering material such as glass cloth, the covering material may effectively comprise the settable composition. In such a case the covering material may comprise a thermoplastic material and, if necessary, one or more of the formers may incorporate heating means to maintain the plasticity of the covering material. It should be noted, however, that setting of such a covering material takes place in the absence of heat.

I claim:

1. A method for making a non planar formed body of particulate insulating material, comprising the steps of:

compacting substantially inorganic non-fusible particulate insulating material in a first forming means to form a planar panel constituting a body having opposite faces;

disposing covering material coated with or comprising a settable composition adjacent at least one said face of the planar panel, in a second forming means;

operating the second forming means to reshape the body of the panel into the desired non-planar form; and allowing the settable composition to harden.

2. A method according to claim 1, wherein covering material coated with or comprising a settable composition is disposed adjacent a second face of the planar panel.

3. A method according to claim 2, wherein the covering material adjacent a second face of the panel is applied after the panel has been formed into the desired non-planar form.

4. A method according to claim 1, wherein the forming means comprises upper and lower formers shaped according to the desired shape of the formed body.

5. A method according to claim 1, wherein the forming means comprises a mould.

6. A method according to claim 1, wherein the covering material is selected from the group consisting of glass cloth, textile cloth, metal cloth and metal foil.

7. A method according to claim 1, wherein the settable composition comprises water glass.

8. A method according to claim 1, wherein the covering material comprises a thermoplastic material.

9. A method according to claim 1, wherein said substantially inorganic non-fusible particulate insulating material consists essentially of a major portion of inorganic powder and a small amount of ceramic fiber.

10. A method for making a non-planar body of particulate insulating material, comprising the steps of:

compacting substantially inorganic non-fusible particulate insulating material in a first forming means to form a planar panel defining a body;

disposing covering material coated with or comprising a settable composition in a second forming means;

disposing the planar panel on the layer of covering material;

operating the second forming means to form the body of the panel into the desired non-planar form; and allowing the settable composition to harden.

11. A method according to claim 10, wherein covering material coated with or comprising a settable composition is disposed on the panel as aforesaid after the panel has been formed into the desired non-planar form.

12. A method according to claim 10, wherein the forming means comprises upper and lower formers shaped according to the desired shape of the formed body.

13. A method according to claim 10, wherein the forming means comprises a mould.

14. A method according to claim 10, wherein the covering material is selected from the group consisting of glass cloth, textile cloth, metal cloth and metal foil.

15. A method according to claim 10, wherein the settable composition comprises water glass.

16. A method according to claim 10, wherein the covering material comprises a thermoplastic material.

17. A method according to claim 10, wherein covering material coated with or comprising a settable composition is disposed on the planar panel prior to operating the second forming means.

18. A method according to claim 10, wherein said substantially inorganic non-fusible particulate insulating material consists essentially of approximately 62% pyrogenic silica, approximately 5% ceramic fiber and approximately 33% rutile powder.

* * * * *